US009828231B2

(12) United States Patent
Carter et al.

(10) Patent No.: US 9,828,231 B2
(45) Date of Patent: Nov. 28, 2017

(54) APPARATUS FOR STORING AND DISPENSING WINE

(71) Applicant: BAM! & Co., LLC, Independence, CO (US)

(72) Inventors: Berrishea Carter, St. Peters, MO (US); Michelle Bunton, St. Peters, MO (US)

(73) Assignee: BAM! & CO., LLC, Independence, MO (US)

( * ) Notice: Subject to any disclaimer, the term of this patent is extended or adjusted under 35 U.S.C. 154(b) by 0 days.

(21) Appl. No.: 15/005,725

(22) Filed: Jan. 25, 2016

(65) Prior Publication Data

US 2016/0137482 A1 May 19, 2016

Related U.S. Application Data

(63) Continuation-in-part of application No. 14/220,911, filed on Mar. 20, 2014, now Pat. No. 9,272,895.

(60) Provisional application No. 61/803,556, filed on Mar. 20, 2013.

(51) Int. Cl.
*B67D 3/00* (2006.01)

(52) U.S. Cl.
CPC ..... *B67D 3/0083* (2013.01); *B67D 3/0067* (2013.01); *B67D 3/0009* (2013.01); *B67D 3/0022* (2013.01)

(58) Field of Classification Search
CPC .... B65D 21/00; B65D 21/02; B65D 21/0209; B65D 21/023; B65D 21/0231; B65D 21/0233; B65D 21/0238; B65D 21/048; B67D 3/0083; B67D 3/0067
USPC ..... 222/143
See application file for complete search history.

(56) References Cited

U.S. PATENT DOCUMENTS 1,330,780 A * 2/1920 Bonte ..... A63H 33/06 206/509
2,696,935 A * 12/1954 Obeck ..... B65D 47/20 222/143
2,818,997 A * 1/1958 Henchert ..... B65D 83/40 222/143
2,862,645 A * 12/1958 Page ..... B65D 88/56 220/1.5
2,950,029 A * 8/1960 Winstead ..... B65D 11/10 206/517
2,956,708 A * 10/1960 Nusbaum ..... F17C 13/084 222/143
3,001,564 A * 9/1961 Hopkins ..... B65D 21/022 206/508
3,270,922 A * 9/1966 Schmidt ..... B65D 21/0231 206/509

(Continued)

*Primary Examiner* — Patrick M Buechner
(74) *Attorney, Agent, or Firm* — Lewis Brisbois Bisgaard & Smith LLP

(57) ABSTRACT

An apparatus for storing and dispensing a fluid from a flexible portable fluid container is provided. The apparatus includes a bottom surface and at least one sidewall that defining a cavity configured to receive a flexible portable fluid container. A support member extends from the bottom surface of the body into the cavity to help support the flexible portable fluid container. An extruding member extends outwardly from the outside portion of the sidewall and defines a channel that extends from the inside portion of the sidewall through the extruding member. The channel is sized to receive the spout of the flexible portable fluid container.

16 Claims, 10 Drawing Sheets

(56) References Cited

U.S. PATENT DOCUMENTS 3,325,058 A * 6/1967 West, Jr. ..... A47J 31/50 219/433
3,393,846 A * 7/1968 Cannon ..... B60N 3/103 224/540
3,545,641 A * 12/1970 Olson ..... B65D 88/10 206/511
3,977,569 A * 8/1976 Scholle ..... B65D 11/06 222/105
4,746,034 A * 5/1988 Ata ..... B65D 21/0215 141/364
5,613,622 A * 3/1997 Surrena ..... B65D 90/046 220/23.87
5,782,381 A * 7/1998 Woodruff ..... B65D 77/0466 222/131
5,842,606 A * 12/1998 DeVito ..... B67D 1/06 222/132
6,378,719 B1 * 4/2002 Kaiser ..... B67D 1/08 220/4.22
6,474,505 B1 * 11/2002 Waters ..... B67D 1/04 222/143
6,578,802 B1 * 6/2003 Thier ..... B67D 3/0029 248/146
D585,693 S * 2/2009 Wright ..... D7/309
2003/0115902 A1 * 6/2003 Busick ..... B67D 1/0869 62/389
2007/0045355 A1 * 3/2007 Claussen ..... B65D 88/10 222/425
2007/0187435 A1 * 8/2007 Quirk ..... B67D 3/0009 222/481
2007/0277547 A1 * 12/2007 Veeravagu ..... B67D 3/0009 62/396
2009/0127152 A1 * 5/2009 Bou-Mezrag ..... B65D 21/0231 206/507
2010/0072095 A1 * 3/2010 Salovaara ..... B65D 1/02 206/427
2012/0175013 A1 * 7/2012 Benayas-Perez .... B67D 3/0009 141/82

* cited by examiner

APPARATUS FOR STORING AND DISPENSING WINE

CROSS REFERENCE TO RELATED APPLICATION

This application is a continuation-in-part of U.S. Non-provisional patent application Ser. No. 14/220,911 titled "Apparatus For Storing and Dispensing Wine, filed on Mar. 20, 2014, which claims priority to and is described in U.S. Provisional Patent Application No. 61/803,556, titled "Apparatus For Storing and Dispensing Wine," filed on Mar. 20, 2013, the disclosure of both of which are hereby incorporated by reference.

FIELD OF THE DISCLOSURE

Aspects of the present disclosure involve an apparatus for storing portable fluid containers while allowing for the contents of the portable fluid containers to be dispensed.

BACKGROUND

Wine is consistently a popular drink to provide at social events and restaurants. Traditionally, wine is stored within and served from glass bottles. However, various types of wine are increasingly being stored within and made available from portable fluid containers, including a flexible bladder contained within a box, commonly known as "box wine." Such portable fluid containers generally hold between 3 to 10 liters of wine, which is significantly greater than the usual 750 milliliters that glass bottles often hold, making box wine a preferable choice for social events or restaurants serving a large number of people. However, because many people consider wine to be a premium product, box wine is often perceived to be inferior, either in terms of the wine itself or of the storage mechanism, as compared to wine stored in and served from glass bottles. For this reason alone, many people, restaurants, and groups avoid purchasing or serving wines stored in this fashion, preferring instead to purchase and serve from glass bottles.

SUMMARY

Implementations described and claimed herein address the foregoing problems by providing an apparatus for storing and dispensing wine that is aesthetically pleasing. The apparatus includes a housing with a top portion and a bottom portion. When mated, the top portion and the bottom portion define a cavity configured to receive a flexible portable fluid container including a spout for dispensing a fluid from within the flexible portable fluid container. Further, the top portion includes an opening to receive a spout of the flexible portable fluid container. The apparatus may also include a bottom surface base comprising a concave surface in the outer surface of the bottom portion of the housing and a plurality of support legs extending from the outside surface of the bottom portion of the housing, the plurality of support legs disposed on the outside surface of the bottom portion of the housing along an edge of the concave surface of the bottom portion.

In one particular embodiment, the apparatus may also include stand with two or more legs that retains the apparatus in a manner to allow pouring of the fluid in the housing through the spout. In another embodiment, the multiple apparatus for storing and dispensing wine may be stacked. In this configuration, the concave surface of an upper apparatus provides an area that engages with the convex shape of the top portion of the bottom apparatus. The engagement of the upper apparatus with the lower apparatus when stacked provides support from tipping so that multiple apparatus for storing the wine may be securely stored together.

BRIEF DESCRIPTIONS OF THE DRAWINGS

DETAILED DESCRIPTIONS

Figure 1:
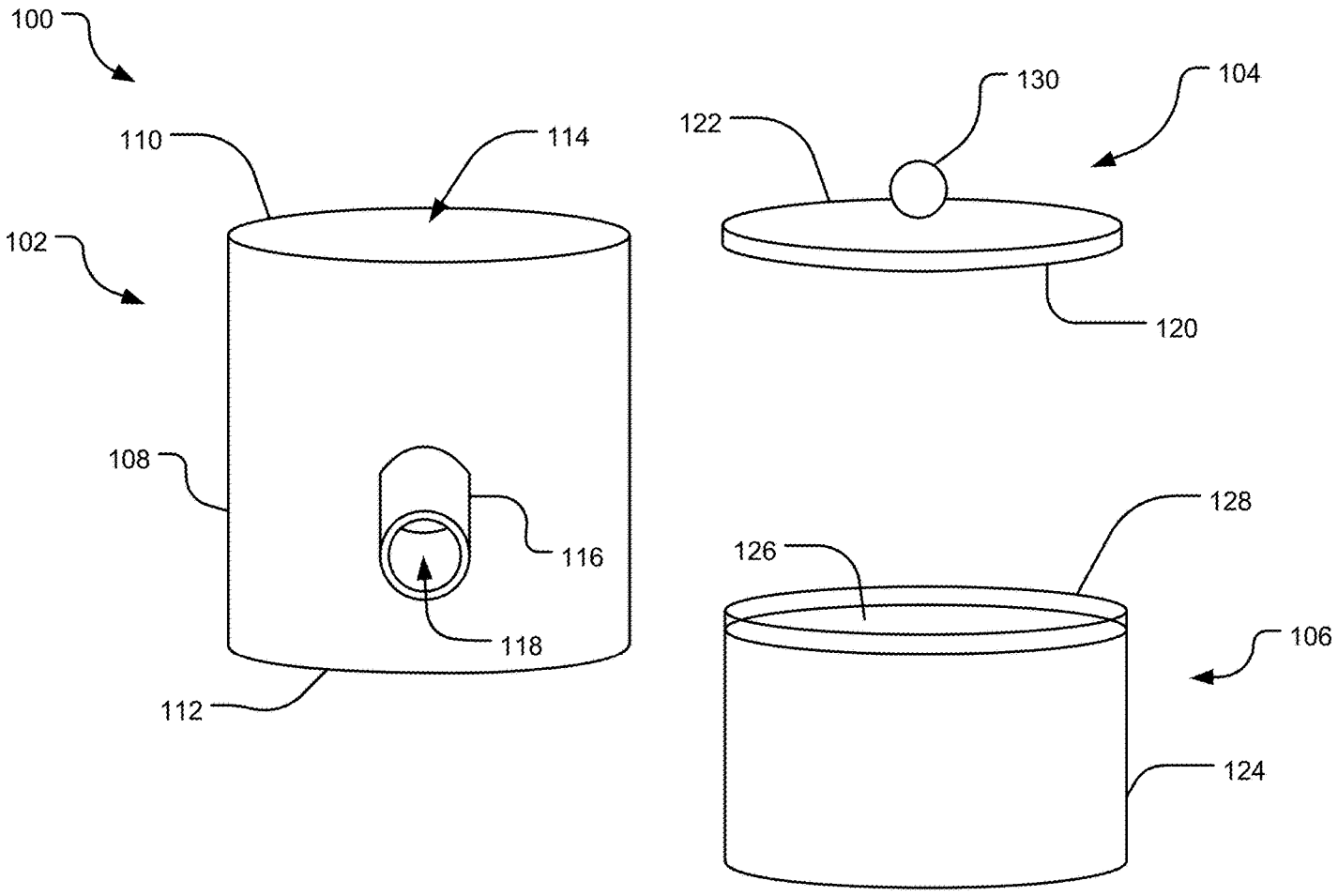
FIG. 1 illustrates a front view an example apparatus for storing and dispensing wine.

FIG. 1 illustrates a front view an example apparatus 100 for storing and dispensing wine. In one implementation, the apparatus 100 includes a housing 102, a lid 104, and a base 106. The housing 102, the lid 104, and/or the base 106 may be made from any robust material, including, but not limited to, ceramic, metal, plastic, wood, stone, or some combination of them. In some implementations the housing 102, the lid 104, and/or the base 106 include decorative features, such as patterns, colors, designs, decals, textures, or other aesthetically pleasing features. Further, one or more of the housing 102, the lid 104, and the base 106 may display a label to identify the contents stored within the housing 102. For example, a plate may be displayed on the housing 102 identifying a type of wine contained within the housing 102.

The housing 102 is adapted to receive a portable fluid container, including, without limitation, a flexible bladder holding a liquid, such as wine, soft drinks, cocktails, or other beverages or consumables. In one implementation, box wine is purchased and the flexible bladder is removed from the box and placed within the housing 102. It will be appreciated by those of ordinary skill that the portable fluid container may be any container or other apparatus adapted to hold and dispense a liquid.

The housing 102 includes a body 108, a top rim 110, and a bottom surface 112. The body 108 may be a variety of shapes, including without limitation, cylindrical, conical, cubical, polygonal, pyramidal, ellipsoidal, spherical, etc. Further, the body 108 may include one or more angular or contoured surfaces or may be sculpted into an aesthetically pleasing figure. The body 108 is sized for easy transport, storage, and presentation and for receiving a variety of sized portable fluid containers, such as a flexible bladder holding 3 to 10 liters of wine. In one implementation, the body 108 is approximately 10 inches tall and approximately 5.5 inches in diameter. The portable fluid container is removable and disposable, while the apparatus 100 is reusable and easy to clean.

In some implementations, the body 108 includes an extruding member 116 extending outwardly from the base 108, for example, a spout. The extruding member 116 has a channel 118 defined therein providing an opening into the cavity 114 for dispensing fluid from the portable fluid container. In some implementations, the channel 118 is a hole directly in the body 108 providing access to the cavity 114. The extruding member 116 may be a variety of shapes and sizes. For example, the extruding member 116 may be contoured or angled. In one implementation, the extruding member 116 is in fluid communication with the fluid stored in the portable fluid container. In another implementation, the portable fluid container includes a spout with a dispensing mechanism for dispensing the fluid, for example, a button, and the spout is threaded through the channel 118 for dispensing the fluid from within the cavity. In such cases, the extruding member 116 may be sized to conceal the spout while enabling access to the dispensing mechanism.

The top rim 110 provides an opening to a cavity 114 defined in the body 108. The top rim 110 may be, for example, smooth, contoured, or angular. However, other shapes and textures are contemplated. The bottom surface 112 is adapted to engage a holding surface, such as a table, stand, base, or floor. The bottom surface 112 is shaped such that when the housing 102 is placed on a holding surface, the housing 102 is steady and cannot be easily tipped over. For example, the bottom surface 112 may be substantially planar or include one or more indents adapted to engage indents in the holding surface to increase steadiness.

In one implementation, the lid 104 includes a lip 120, a surface 122 and a handle 130. The lip 120 is adapted to engage the top rim 110 of the housing 102, thereby securing and concealing the portable fluid container within the cavity 114. The shape of the lip 120 may mirror the shape of the top rim 110. The surface 122 may be, without limitation, generally planar, contoured, and/or angled. The handle 130 is shaped for a user to easily grab and lift the lid 104. For example, the handle 130 may be spherical, contoured, angled, etc. The lid 104 is sized to mirror the housing 102. In one implementation, the lid 104 is approximately 3 to 4 inches in diameter. However, other dimensions are contemplated.

The base 106 is adapted to hold the housing 102 by engaging the bottom surface 112. In one implementation, the base 106 includes a stand 124, a holding surface 126, and a lip 128. The stand 124 may be a generally solid or hollow body, legs, or other components for elevating the holding surface 126 off the ground or a serving surface, such as a table. The holding surface 126 is adapted to engage the bottom surface 112. The holding surface 126 may be a variety of shapes and sizes that generally mirror the bottom surface 112. For example, the holding surface 126 may be substantially planar or include one or more indents adapted to engage indents in the bottom surface 112 to increase steadiness. In one implementation, the lip 128 extrudes from the holding surface 126 to provide additional stability for the housing 102. The base 106 may be a variety of heights suitable for easy dispensing and access, including, for example, approximately 4 inches tall.

Figure 2:
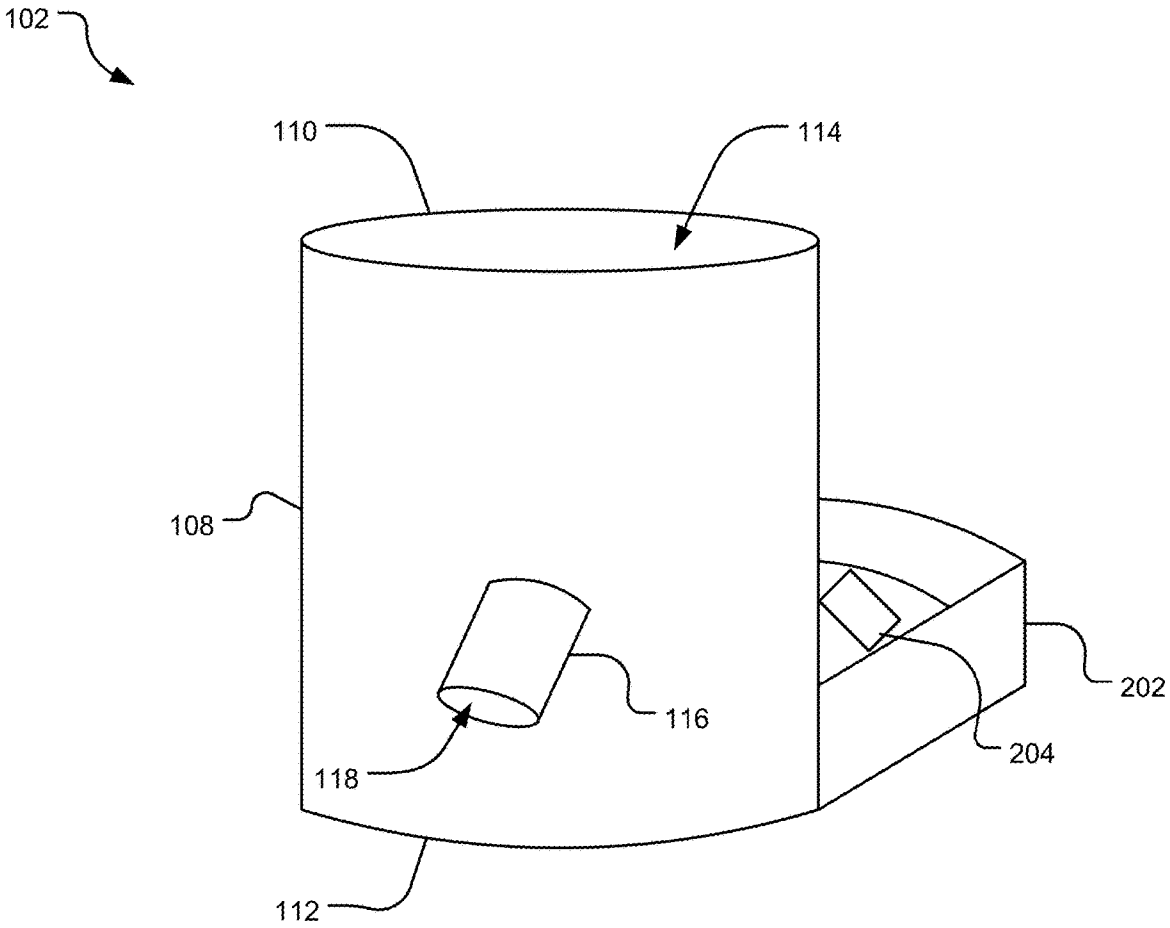
FIG. 2 illustrates a side perspective view the apparatus of FIG. 1 showing a cooling drawer in an open position.

Some implementations include a temperature system configured to keep the contents contained in the housing 102 within a certain temperature range. For example, as shown in FIG. 2, the temperature system may include a drawer 202. Ice or other coolants 204 may be placed within the drawer 202 to keep the contents contained in the housing 102 chilled or cold. On the other hand, heating mechanisms 204 may be placed within the drawer 202 to keep the contents warm or hot. For example, white wine is generally served chilled, so ice or other coolants 204 may be placed in the drawer 202 so that when the white wine is dispensed from the housing 102, the white wine is chilled. Further, if a warm drink, such as cider or hot chocolate is being served from the housing 102, heaters or other heating mechanisms 204 may be placed in the drawer 202 to serve the beverage hot.

Figure 3:
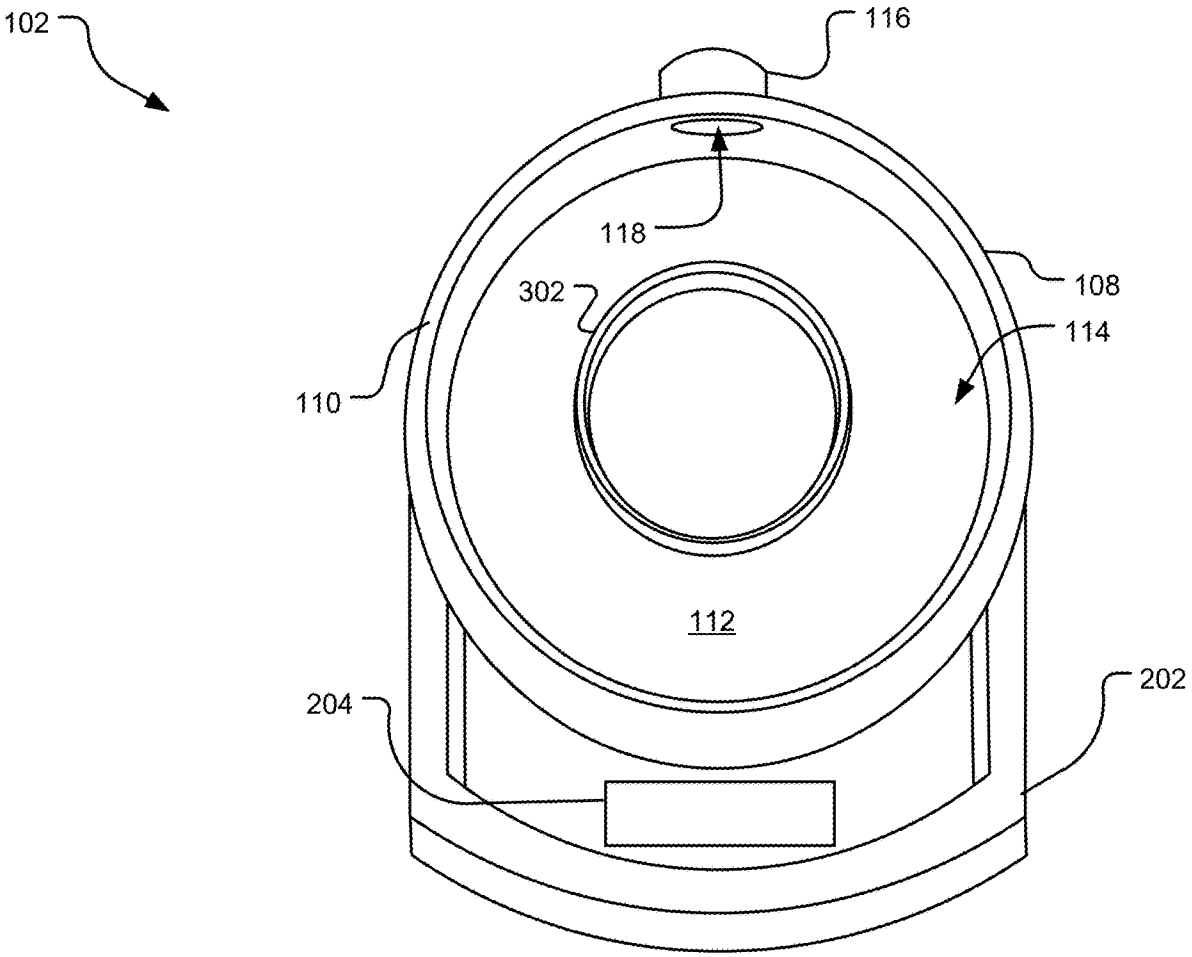
FIG. 3 illustrates a top view of the apparatus of FIG. 2.

As can be understood from FIG. 3, the drawer 202 may slide in below the bottom surface 112. In such implementations, the portable fluid container may be placed within the cavity 114 on the bottom surface 112. In such cases, the bottom surface 112 would be heated or cooled from by the contents 204 of the drawer 202, and the bottom surface 112 would heat or cool the contents in the portable fluid container. The housing 102 may include a support member 302 extending from the bottom surface 112 to hold the portable fluid container in a position relative to the channel 118 to ensure that the fluid may be dispensed from the portable fluid container. In one example, the support member 302 has a tubular shape that extends from the bottom surface 112 and is sized to prevent the fluid container from moving. For example, in some cases, the portable fluid container may be flexible. The support member 302 is therefore shaped to facilitate the ability to hold the portable fluid container in place. Further, the support member 302 holds the portable fluid container relative to the temperature system to maintain the contents at a desired temperature. In other implementations, the temperature system may be integrated into the body 108 or spread throughout the cavity 114 for uniform cooling and heating of the contents of the portable fluid container.

Figure 4:
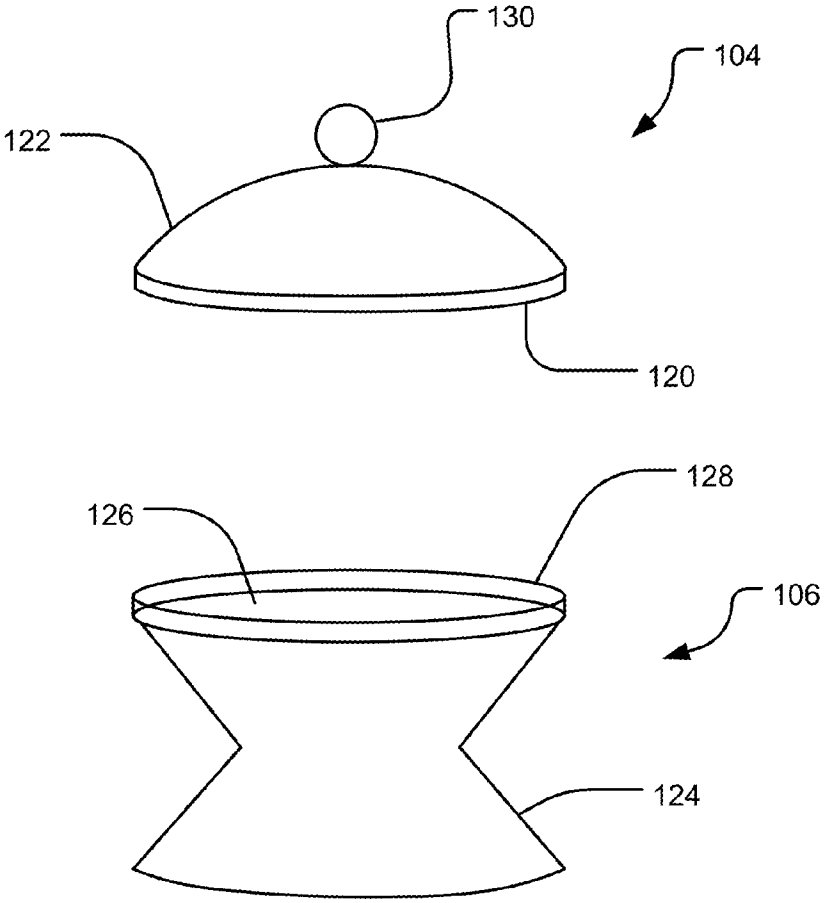
FIG. 4 illustrates a front view of an example base and lid.
Figure 5:
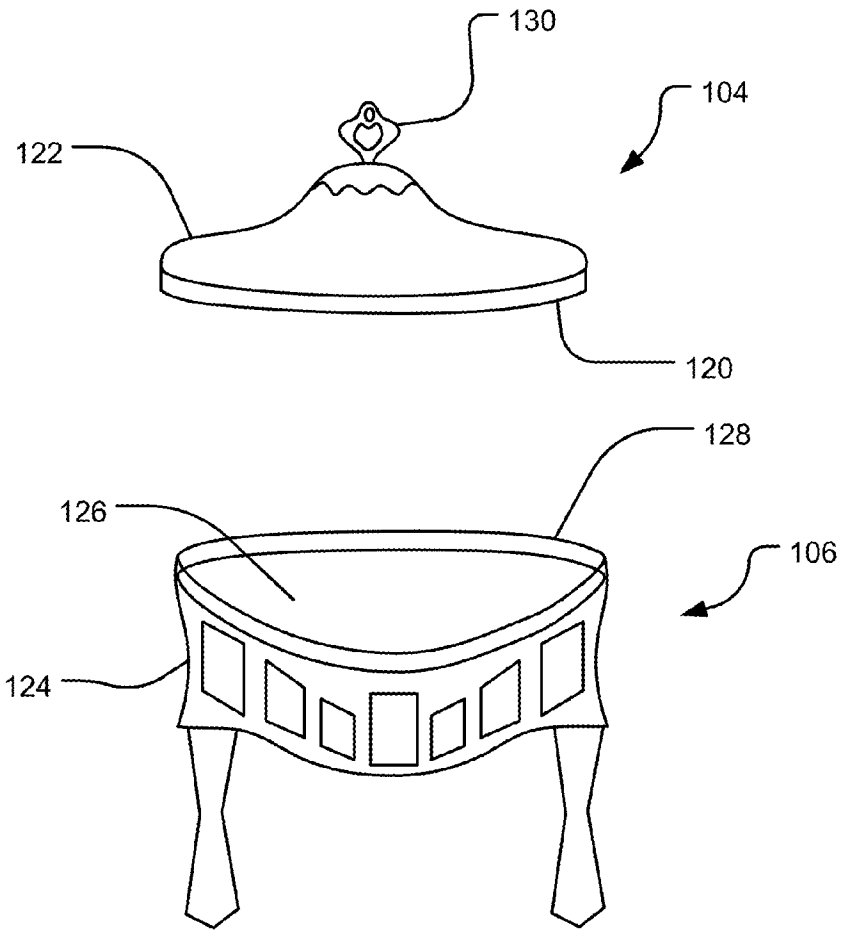
FIG. 5 illustrates a front view of another example base and lid.

The apparatus 100 may come in a variety of shapes, designs, and styles. For example, FIGS. 4 and 5 illustrate example modern and rustic styles, respectively. As shown in FIG. 4, the surface 122 of the lid 104 may be contoured, for example, forming a hemi-ellipsoidal shape, and the handle 130 of the lid 104 may be generally spherical. The stand 124 of the base 106 is a solid or hollow, angled body. FIG. 5 shows the surface 122 of the lid 104 being contoured to form a bulge shape having a design, and the handle 130 is shaped to form a design. The stand 124 of the base 106 includes a body having a design with legs extending from the body. The legs are shown with a contoured shape. Other shapes, designs, and styles are contemplated.

Figure 6:
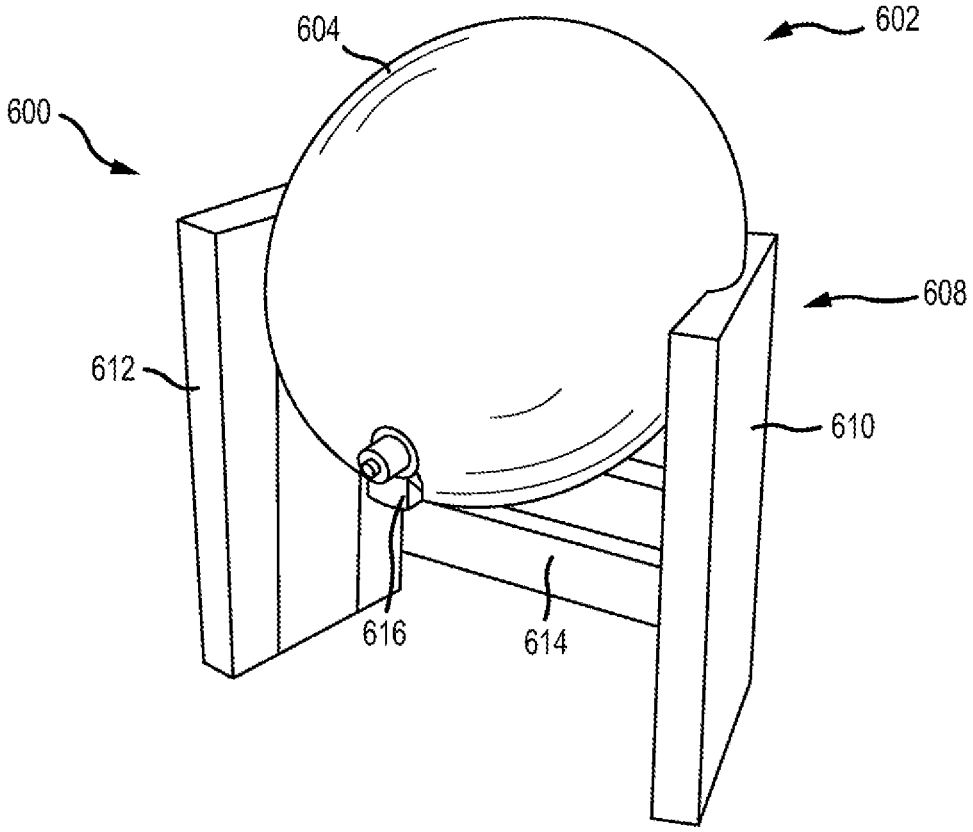
FIG. 6 illustrates a front isolation view of a third example apparatus for storing and dispensing wine.
Figure 7:
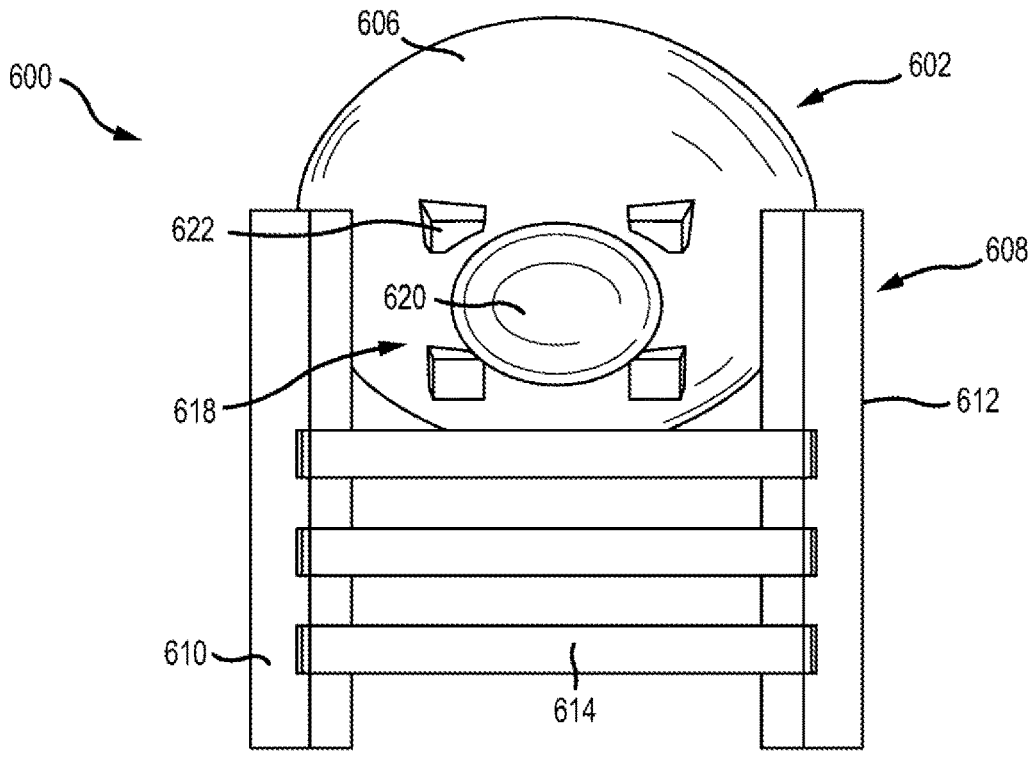
FIG. 7 illustrates a back view of the third example apparatus for storing and dispensing wine.
Figure 8:
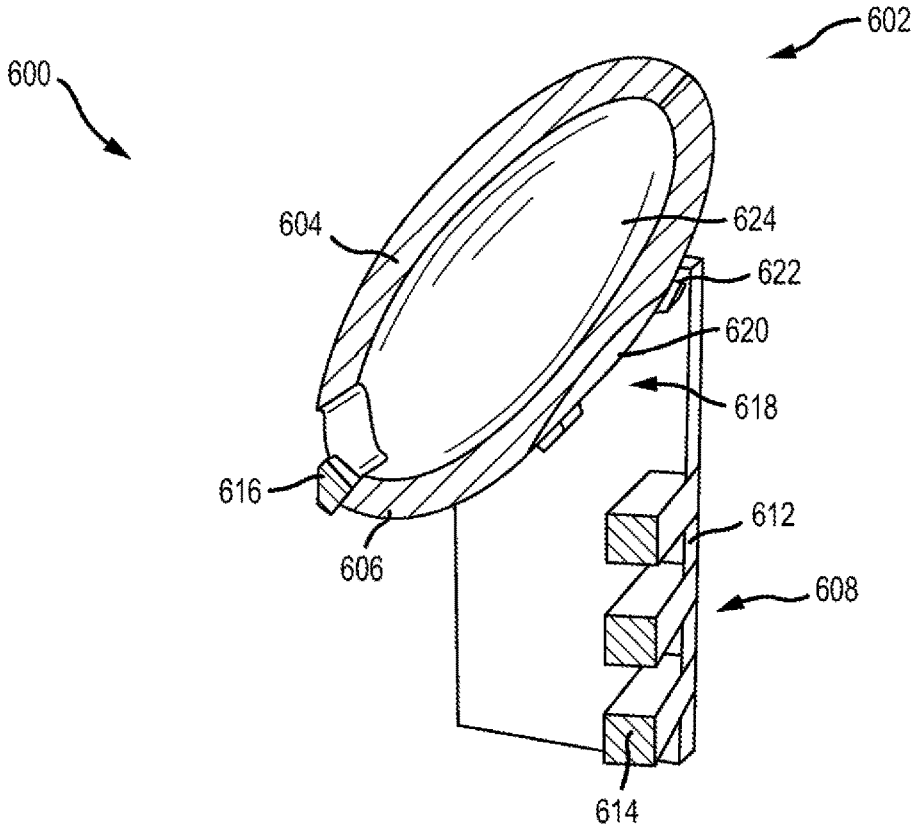
FIG. 8 illustrates a cross-section view of the third example apparatus for storing and dispensing wine.

Yet another example of the apparatus for storing and dispensing wine is shown in FIGS. 6-9. In particular, FIG. 6 is a front isolation view of a third example apparatus for storing and dispensing wine, FIG. 7 illustrates a back view of the third example apparatus for storing and dispensing wine, and FIG. 8 illustrates a cross-section view of the third example apparatus for storing and dispensing wine. Similar to the examples above, the third embodiment 600 includes a housing 602 and a base 608. The housing includes a top portion 604 and a bottom portion 606. One or each of the top portion 604 and the bottom portion 606 of the housing 602 may include a lip adapted to engage a lip of the opposite portion, thereby securing and concealing a portable fluid container within the housing 602. In the embodiment 600 illustrated in FIGS. 6-9, the housing 602 is of an oblate spheroid shape, although the housing may be of any shape. As described in more detail below, the bottom portion 606 includes a bottom surface base 618 within the oblate spheroid shape that allows the housing 600 adapted to engage a holding surface, such as a table, stand, base, or floor.

As shown in the cross-section view of FIG. 8, the housing 602 is adapted to receive a portable fluid container, including, without limitation, a flexible bladder holding a liquid, such as wine, soft drinks, cocktails, or other beverages or consumables. In one implementation, box wine is purchased and the flexible bladder is removed from the box and placed within the housing. It will be appreciated by those of ordinary skill that the portable fluid container may be any container or other apparatus adapted to hold and dispense a liquid. Also similar to the embodiment discussed above, the housing 602 includes an extruding member 616 extending outwardly from the top portion 604, for example, a spout. The extruding member 616 has a channel defined therein providing an opening into the cavity 624 for dispensing fluid from the portable fluid container.

In one embodiment, the housing 602 is disposed on a stand 608. The stand includes a first leg 610, a second leg 612, and at least one cross beam 614. Although shown as including three cross beams 614, the stand 608 may include any number of cross beams. In general, the stand 608 is configured to hold the housing 602 and orient the housing such that the extruding member 616 is parallel or near parallel to the surface upon which the stand is located to allow the extraction of fluid from the portable fluid container within the cavity 624. Thus, any stand that holds the housing and orients the housing as described is contemplated herein with the stand 608 illustrated in FIGS. 6-8 being one example of such a stand.

As mentioned above, the bottom portion 606 of the housing 602 includes a bottom surface base 618 within the oblate spheroid shape. In particular, the bottom surface base 618 includes a concave surface 620 in the bottom portion 606 of the housing 602. The bottom surface base 618 also includes any number of housing legs 622 that extend from the bottom portion 606 of the housing 602. In one particular embodiment, the bottom surface base 618 includes four legs. The legs 622 include at least a partially flat surface opposite where the legs connect to the bottom portion 606 of the housing 602 to allow the housing 602 to be stable when placed on a flat surface, such as a table or a floor.

Figure 9A:
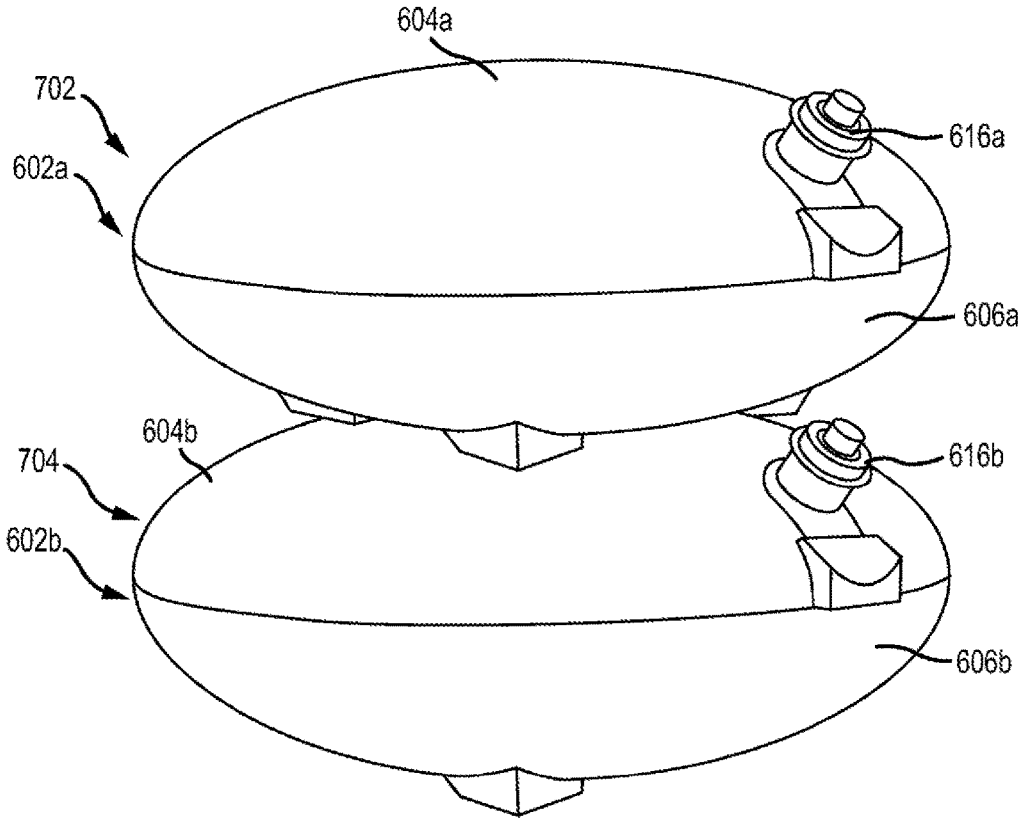
FIG. 9A illustrates a stacked configuration of a plurality of the third example apparatus for storing and dispensing wine.
Figure 9B:
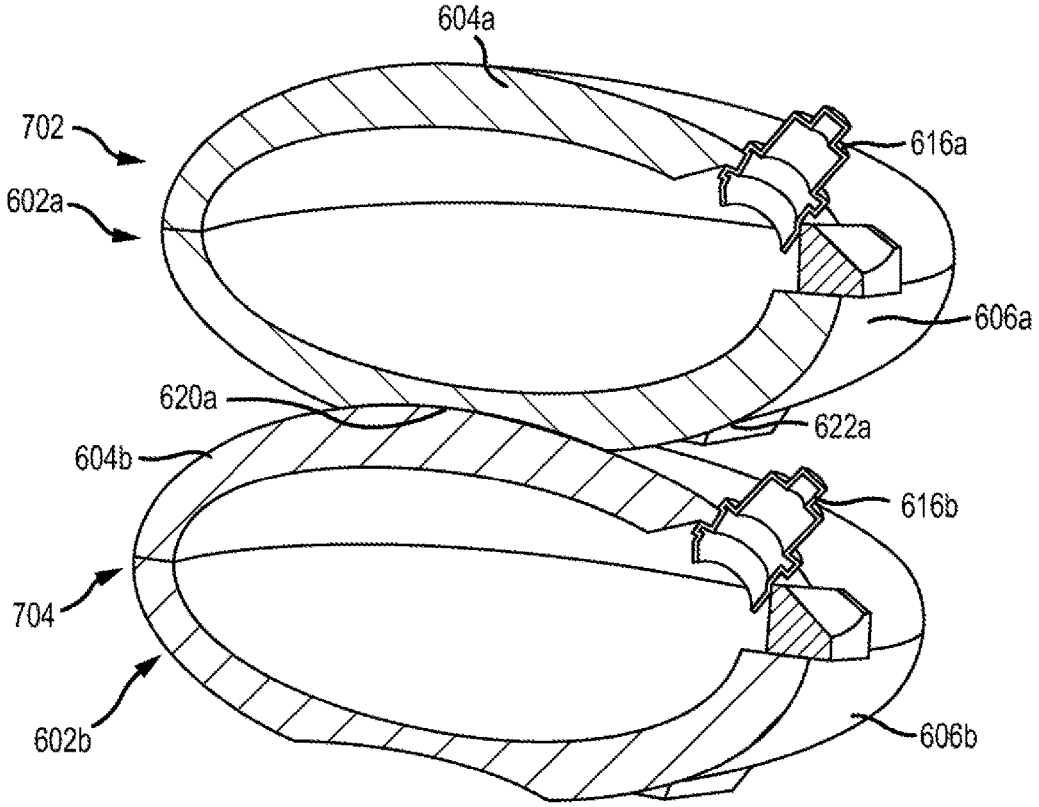
FIG. 9B illustrates a cross section view of the stacked configuration of a plurality of the third example apparatus for storing and dispensing wine.

Further, as illustrated in FIGS. 9A-9B, multiple apparatus for storing and dispensing wine may be stacked. When stacked, the concave surface in the bottom portion 606*a* of the housing 602*a* of an uppermost apparatus 702 provides an area that accepts the top portion 604*b* of the bottommost apparatus 704. In other words, the convex shape of the top portion 604*b* of the bottommost apparatus 704 in the stacked configuration fits within the concave surface 620*a* in the bottom portion 606*a* of the housing 602*a* of an uppermost apparatus 702. In general, the surface 620*a* in the bottom portion 606*a* of the housing 602*a* of the uppermost apparatus 702 may be any shape to engage the top portion 604*b* of the bottommost apparatus 704. Further, the legs 622*a* of the uppermost apparatus 702 may at least partially rest on the top portion 604*b* of the bottommost apparatus 704 to provide stability to the uppermost apparatus when stacked. In this manner, any number of wine storing and dispensing apparatus may be stacked on top of one another.

All directional references (e.g., proximal, distal, upper, lower, upward, downward, left, right, lateral, front, back, top, bottom, above, below, vertical, horizontal, clockwise, and counterclockwise) are only used for identification purposes to aid the reader's understanding of the presently disclosed technology and do not create limitations, particularly as to the position, orientation, or use of the presently disclosed technology.

The above specification and examples provide a complete description of the structure and use of exemplary implementations. Although various implementations have been described above with a certain degree of particularity, or with reference to one or more individual implementations, those skilled in the art could make numerous alterations to the disclosed implementations without departing from the spirit or scope of the presently disclosed technology. Other implementations are therefore contemplated. It is intended that all matter contained in the above description and shown in the accompanying drawings shall be interpreted as illustrative only of particular implementations and not limiting. Changes in detail or structure may be made without departing from the basic elements of the presently disclosed technology, as defined in the following claims.

What is claimed is:

1. An apparatus for storing and dispensing a fluid, the apparatus comprising:

a flexible portable fluid container comprising a spout for dispensing a fluid from within the flexible portable fluid container;

a housing comprising a top portion and a bottom portion, the housing defining a cavity generally configured to receive the flexible portable fluid container, wherein the top portion comprises an opening to receive the spout of the flexible portable fluid container and the bottom portion comprising an inner surface and an outer surface; and a bottom surface base of the bottom portion of the housing, the bottom surface base comprising a concave surface in an outside surface of the bottom portion of the housing and a plurality of support legs extending from the outside surface of the bottom portion of the housing, the plurality of support legs disposed on the outside surface of the bottom portion of the housing along an edge of the concave surface of the bottom portion.

2. The apparatus of claim 1 further comprising:

a stand configured to retain the housing in an elevated position such that the fluid within the flexible portable fluid container flows from the spout of the flexible portable fluid container.

3. The apparatus of claim 2 wherein the stand comprises a first upright leg, a second upright leg, and at least one crossbeam disposed between the first upright leg and the second upright leg.

4. The apparatus of claim 3 wherein the at least one crossbeam comprises three crossbeams disposed between the first upright leg and the second upright leg.

5. The apparatus of claim 1 wherein the plurality of support legs disposed on the outside surface of the bottom portion comprise an at least partially flat surface opposite the bottom portion of the housing.

6. The apparatus of claim 1 wherein the concave surface in the outer surface of the bottom portion of the housing is configured to engage a top portion of a second apparatus for storing and dispensing a fluid when the apparatus for storing and dispensing the fluid is stacked on the second apparatus.

7. The apparatus of claim 1 wherein the housing comprises a generally oblate spheroid shape.

8. An apparatus for storing and dispensing a fluid, the apparatus comprising:

a flexible portable fluid container comprising a spout for dispensing a fluid from within the flexible portable fluid container;

a housing comprising a top portion and a bottom portion, the housing defining a cavity generally configured to receive the flexible portable fluid container, wherein the top portion comprises an opening to receive the spout of the flexible portable fluid container and the bottom portion comprising an inner surface and an outer surface;

a bottom surface base of the bottom portion of the housing, the bottom surface base comprising a concave surface in the outer an outside surface of the bottom portion of the housing and a plurality of support legs extending from the outside surface of the bottom portion of the housing, the plurality of support legs disposed on the outside surface of the bottom portion of the housing along an edge of the concave surface of the bottom portion; and a stand configured to retain the housing in an elevated position such that the fluid within the flexible portable fluid container flows from the spout of the flexible portable fluid container.

9. The apparatus of claim 8 wherein the stand comprises a first upright leg, a second upright leg, and at least one crossbeam disposed between the first upright leg and the second upright leg.

10. The apparatus of claim 9 wherein the at least one crossbeam comprises three crossbeams disposed between the first upright leg and the second upright leg.

11. The apparatus of claim 8 wherein the plurality of support legs disposed on the outside surface of the bottom portion comprise an at least partially flat surface opposite the bottom portion of the housing.

12. The apparatus of claim 8 wherein the concave surface in the outer surface of the bottom portion of the housing is configured to engage a top portion of a second apparatus for storing and dispensing a fluid when the apparatus for storing and dispensing the fluid is stacked on the second apparatus.

13. The apparatus of claim 8 wherein the housing comprises a generally oblate spheroid shape.

14. An apparatus for storing and dispensing a fluid, the apparatus comprising:

a first flexible portable fluid container comprising a spout for dispensing a fluid from within the flexible portable fluid container;

an upper housing unit comprising a top portion and a bottom portion defining a cavity configured to receive the first flexible portable fluid container, and a bottom surface base comprising a concave surface in an outer surface of the bottom portion of the upper housing unit and a plurality of support legs extending from the outside surface of the bottom portion of the upper housing unit; and a second flexible portable fluid container comprising a spout for dispensing a fluid from within the flexible portable fluid container;

a lower housing unit comprising a top portion and a bottom portion defining a cavity configured to receive the second flexible portable fluid container, and a bottom surface base comprising a concave surface in an outer surface of the bottom portion of the lower housing unit and a plurality of support legs extending from the outside surface of the bottom portion of the lower housing unit;

wherein the upper housing unit and the lower housing unit are stacked such that the upper housing unit rests on the lower housing unit.

15. The apparatus of claim 14 wherein the concave surface in the outer surface of the bottom portion of the upper housing unit is configured to engage a corresponding convex portion of the top portion of the lower housing unit.

16. The apparatus of claim 15 wherein the plurality of support legs disposed on the outside surface of the bottom portion of the lower housing unit comprise an at least partially flat surface opposite the bottom portion of the lower housing unit.

* * * * *